US005778453A

United States Patent [19]

Chen

[11] Patent Number: 5,778,453

[45] Date of Patent: Jul. 14, 1998

[54] NECKTIE

[76] Inventor: Hui-Shen Chen, P.O. Box 82-144, Taipei, Taiwan

[21] Appl. No.: 739,214

[22] Filed: Oct. 29, 1996

[51] Int. Cl.[6] ..... A41D 25/00; A41D 25/02

[52] U.S. Cl. ..... 2/148; 2/150; 2/151; 2/152.1; 2/153; 2/154

[58] Field of Search ..... 2/144, 145, 146, 2/147, 148, 149, 150, 151, 152.1, 153, 154, 155, 156, 157

[56] References Cited

U.S. PATENT DOCUMENTS

| | | | |
|---|---|---|---|
| 2,422,992 | 6/1947 | Taborski | 2/144 |
| 3,052,937 | 9/1962 | Caparosa | 24/49 |
| 3,069,689 | 12/1962 | Caparosa | 2/154 |
| 3,071,776 | 1/1963 | Phillips et al. | 2/154 |
| 3,146,469 | 9/1964 | Leuko | 2/153 |
| 3,649,965 | 3/1972 | Krivda | 2/154 |
| 4,897,887 | 2/1990 | Chen et al. | 2/150 |
| 5,084,916 | 2/1992 | Austin | 2/149 |
| 5,088,120 | 2/1992 | Yen | 2/152 |

FOREIGN PATENT DOCUMENTS

| | | | |
|---|---|---|---|
| 148958 | 11/1952 | United Kingdom | 2/153 |

*Primary Examiner*—Jeanette E. Chapman
*Attorney, Agent, or Firm*—A & J

[57] ABSTRACT

A necktie including a knot formed with a seat, a binding device having a fixing block removably engaged with the seat of the knot, and a front apron provided with fastening means at an upper end thereof engageable with the knot, whereby the front apron of the necktie can be changed as desired and the necktie can be easily converted to a bowtie thereby providing the user with a number of options and when pulled by a force which is larger than the holding force of the front apron, the front apron will be disengaged from the knot hence preventing the user from getting hurt.

1 Claim, 2 Drawing Sheets

NECKTIE

BACKGROUND OF THE INVENTION

1. Field of the Invention

This invention is related to a necktie and in particular to one which can be changed as desired.

2. Description of the Prior Art

The conventional necktie is a strip of material worn round the neck under the collar and tied with a knot in front. However, one must be very careful in wearing a necktie in order to keep the front apron at an appropriate length. Furthermore, it is very difficult for a newcomer to tie the necktie with a beautiful knot. Hence, a pre-tied necktie which includes an inner tie provided with a zip fastener, an outer tie containing a wide end of a conventional necktie and a knot support has been developed to eliminate these drawbacks. Nevertheless, such a pre-tied necktie will probably hurt the wearer in case of a strong pull on the necktie. In addition, the front apron of the pretied necktie cannot be changed as desired.

Therefore, it is an object of the present invention to provide an improved necktie which can obviate and mitigate the above-mentioned drawbacks.

SUMMARY OF THE INVENTION

This invention relates to an improved necktie.

It is the primary object of the present invention to provide a necktie of which the front apron can be changed as desired.

It is another object of the present invention to provide a necktie which can be easily converted to a bow tie.

It is still another object of the present invention to provide a necktie the front apron of which will be disengaged from the knot when strong pulled by an external force so that it would not cause harm.

It is still another object of the present invention to provide a necktie which is convenient to wear.

It is a further object of the present invention to provide a necktie which is simple in construction and easy to manufacture.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
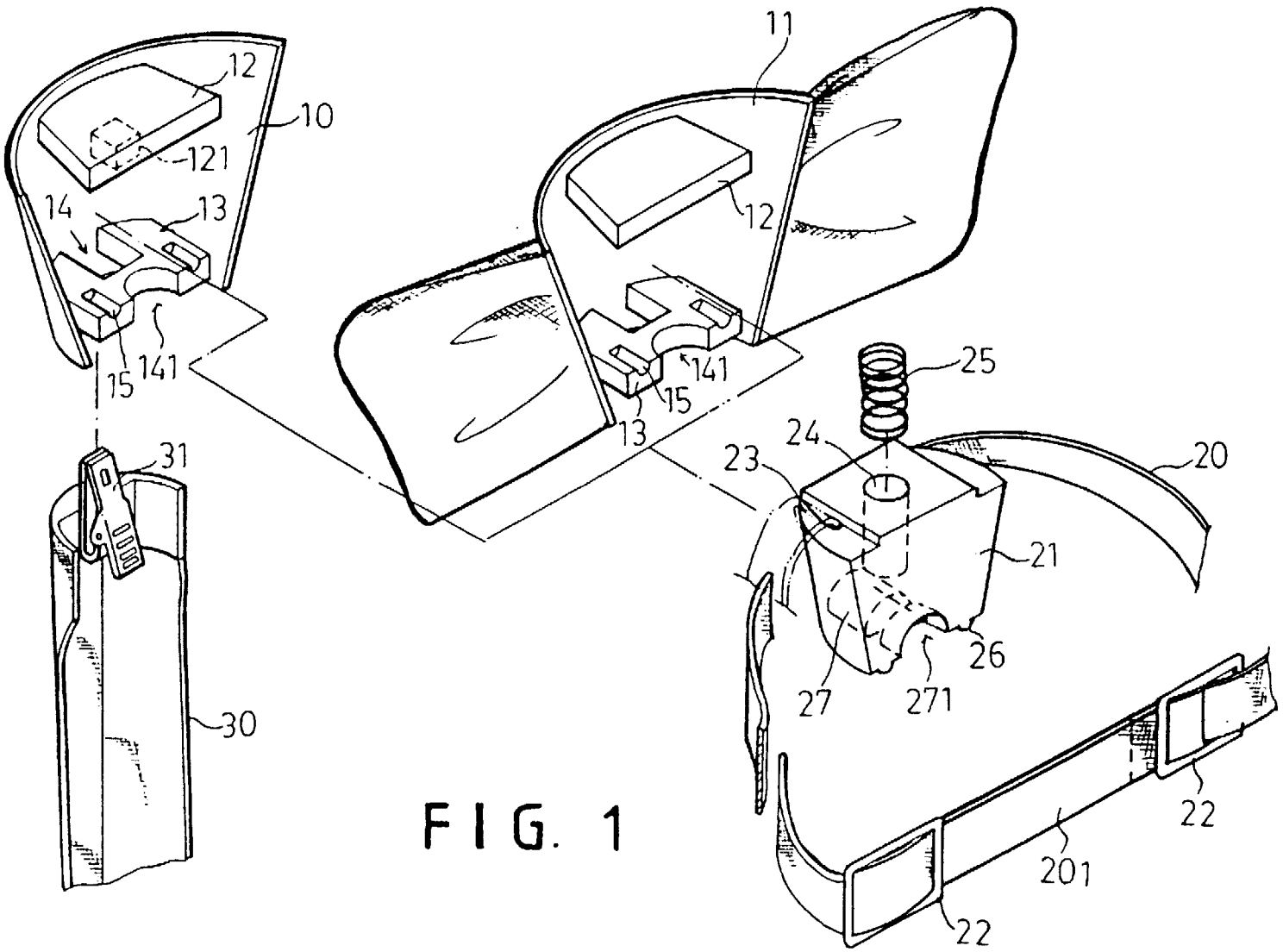
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
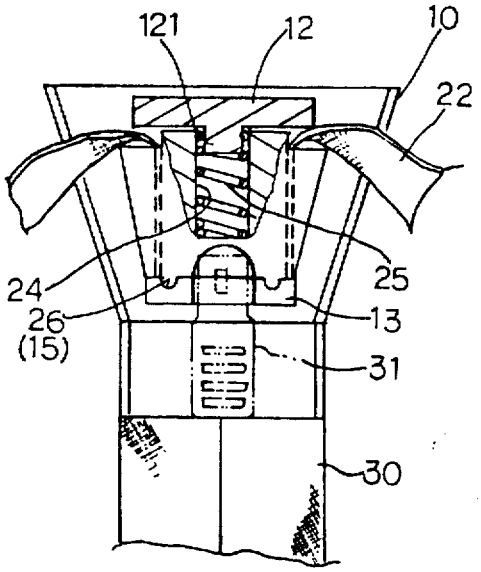
FIG. 2 is a sectional front view showing the engagement between the knot and the front apron.
Figure 3:
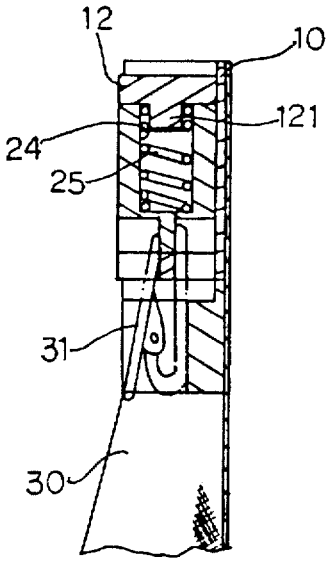
FIG. 3 is a sectional side view showing the engagement between the knot and the front apron.

With reference to the drawings and in particular to FIGS. 1, 2 and 3 thereof, the necktie according to the present invention comprises a knot 10, a bowknot 11, a binding device 20 and a front apron 30.

The knot 10 is a curved triangular sheet member the inner side of which are provided with an upper positioning plate 12 and a lower positioning plate 13. The upper positioning plate 12 has a protuberance 121 at its bottom. The lower positioning plate 13, which is located right under the upper positioning plate 12, has a first opening 14 at the inner side, a second opening 141 at the outer side and two grooves 15 at two sides of the second opening 141. The bowknot 11 has similar structure as the knot 10 and both the knot 10 and bowkknot 11 may be of any desired shape.

The binding device 20 includes a fixing block 21, two buckles 22 and a strap 201. The two buckles 22 are used for adjusting the length of the strap 201. The strap 201 is fixedly connected with one side of the fixing block 21 at an end. The other end of the strap 201 is detachably connected with the another side of the fixing block 21 and kept in place by a resilient member 23. The strap 201 may be conveniently replaced with an elastic band. The fixing block 21 is formed with a vertical through hole 24 in which is fitted a helical spring 25, a pair of legs 26 at the bottom adapted to engage with the grooves 15 of the lower positioning plate 13 of the knot 10, and a first semi-cirular recesses 27 and a second semi-circular recesses 271 at the bottom and located between the two legs 26. The partition wall between the two recesses 27 and 271 is slightly less than the partition wall between the first and second openings 14 and 141 in thickness. The fixing block 21 is arranged between the upper positioning plate 12 and the lower positioning plate 13, with the upper end of the helical spring 25 engaged with the protuberance 21 of the upper positioning plate 12, the legs 26 received in the grooves 15 of the lower positioning plate 13 and the first and second semi-circular recesses 27 and 271 aligned with the first and second openings 14 and 141 respectively.

The front apron 30 is provided with a clip 31 at the upper end so that the front apron 30 can be easily engaged with the knot 10 by engaging the clip 31 with the partition walls between the first and second openings 14 and 141 of the knot 10 and between the first and second semi-circular recesses 27 and 271 of the binding device 20.

Figure 4:
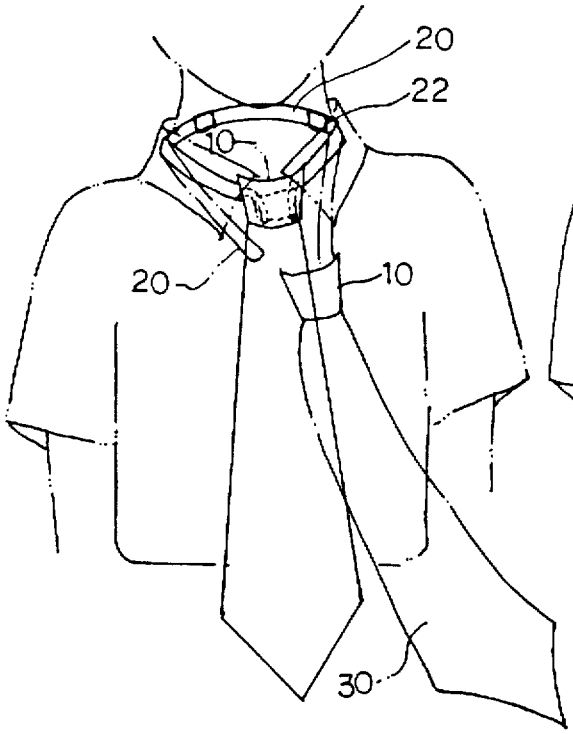
FIG. 4 illustrates how to convert the necktie to a bow tie.
Figure 5:
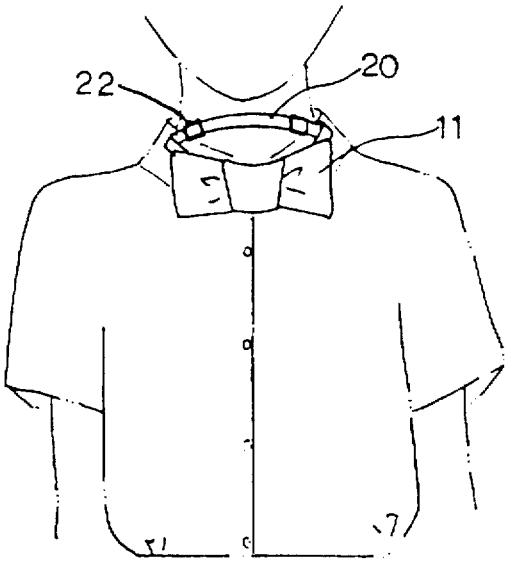
FIG. 5 illustrates how the disengagement of the front apron from the knot in case of a strong pull on the front apron.

From the above description, it is manifest that the front apron 30 can be changed as desired thereby providing the user with a number of optional patterns. Furthermore, the necktie according to the present invention can be easily converted to a bowtie as desired (see FIG. 4). In addition, when the front apron 10 is pulled by a force which is larger than the holding force of the clip 31, the front apron 10 will be disengaged from the binding device 30 hence preventing the user from danger (see FIG. 5).

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A necktie comprising:

a knot form constructed with a seat;

a binding device having a fixing block removably engaged with said seat of said knot, said seat of said knot including an upper positioning plate and a lower positioning plate, said upper positioning plate having a bottom formed with a protuberance, said lower positioning plate being formed with a first and a second openings which are separated by a partition wall, said lower positioning plate having top formed with a pair of grooves, said binding device further including a strap, said strap having an end connected with one side of said fixing block and another end connected with a resilient member installed on another side of said fixing block, said fixing block having a vertical through hole in which is fitted a helical spring having an upper end engaged with said protuberance of said upper plate, said fixing block further having a bottom formed with two legs adapted to engage with said grooves and and having a first and second recesses which are separated by a partition wall; and a front apron provided with a fastening means at an upper end thereof engageable with said knot.

* * * * *